US010731416B2

(12) United States Patent
Marland

(10) Patent No.: US 10,731,416 B2
(45) Date of Patent: Aug. 4, 2020

(54) SYSTEM AND METHOD TO CONTROL ADJUSTABLE PADS FOR USE IN DOWNHOLE DIRECTIONAL DRILLING ASSEMBLIES

(71) Applicant: Halliburton Energy Services, Inc., Houston, TX (US)

(72) Inventor: Christopher N. Marland, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 146 days.

(21) Appl. No.: 15/850,156

(22) Filed: Dec. 21, 2017

(65) Prior Publication Data

US 2019/0195023 A1 Jun. 27, 2019

(51) Int. Cl.

| | |
|---|---|
| ***E21B 7/06*** | (2006.01) |
| ***E21B 4/00*** | (2006.01) |
| *E21B 10/62* | (2006.01) |

(52) U.S. Cl.

CPC ..... *E21B 7/06* (2013.01); *E21B 4/003* (2013.01); *E21B 7/067* (2013.01); *E21B 10/62* (2013.01)

(58) Field of Classification Search

CPC ..... E21B 7/067; E21B 7/061; E21B 7/068; E21B 17/1014

See application file for complete search history.

(56) References Cited

U.S. PATENT DOCUMENTS 4,776,395 A 10/1988 Baker et al.
5,318,138 A * 6/1994 Dewey ..... E21B 23/04 175/74
6,328,119 B1 * 12/2001 Gillis ..... E21B 7/062 175/325.1
6,626,254 B1 9/2003 Krueger et al.
2010/0025116 A1 2/2010 Hutton
2010/0071962 A1 3/2010 Beuershausen
2011/0120775 A1 * 5/2011 Krueger ..... E21B 7/067 175/73
2016/0290050 A1 * 10/2016 Murray ..... E21B 17/1064
2019/0128096 A1 * 5/2019 Farley ..... E21B 7/067

FOREIGN PATENT DOCUMENTS

WO 2014107232 7/2014
WO 2019009911 1/2019

OTHER PUBLICATIONS

International Search Report and Written Opinion of PCT/US2018/048538 dated Feb. 8, 2019: pp. 1-17.

* cited by examiner

*Primary Examiner* — Giovanna Wright
(74) *Attorney, Agent, or Firm* — Chamberlain Hrdlicka

(57) ABSTRACT

A system, drilling assembly, and method to control adjustable pads for use in downhole directional drilling. The drilling assembly comprises a bent housing comprising an upper section, a lower section, a bend between the upper and lower sections, and a bore extending from the upper to lower sections. The drilling assembly also comprises a drill bit coupled to a lower end of the bent housing and a fluid-driven motor coupled to the bent housing and comprising a drive shaft coupled to the drill bit. The drilling assembly also employs an adjustable pad extendable and retractable from an exterior of the bent housing to engage and disengage the wellbore wall to adjust a drilling direction of the drill bit, and a fluid control system operable to control extension of the pad.

17 Claims, 6 Drawing Sheets

SYSTEM AND METHOD TO CONTROL ADJUSTABLE PADS FOR USE IN DOWNHOLE DIRECTIONAL DRILLING ASSEMBLIES

BACKGROUND

Directional wellbore operations, such as directional drilling, involve varying or controlling the direction of a downhole tool (e.g., a drill bit) in a wellbore to direct the tool towards a desired target destination. Various techniques have been used for adjusting the direction of a tool string in a wellbore. Slide drilling employs a downhole motor and a bent housing to deflect the wellbore. In slide drilling, the direction of the wellbore is changed by using the downhole motor to rotate the bit while drill string rotation is halted and the bent housing is oriented to deflect the bit in the desired direction.

DESCRIPTION OF THE DRAWINGS

Embodiments are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
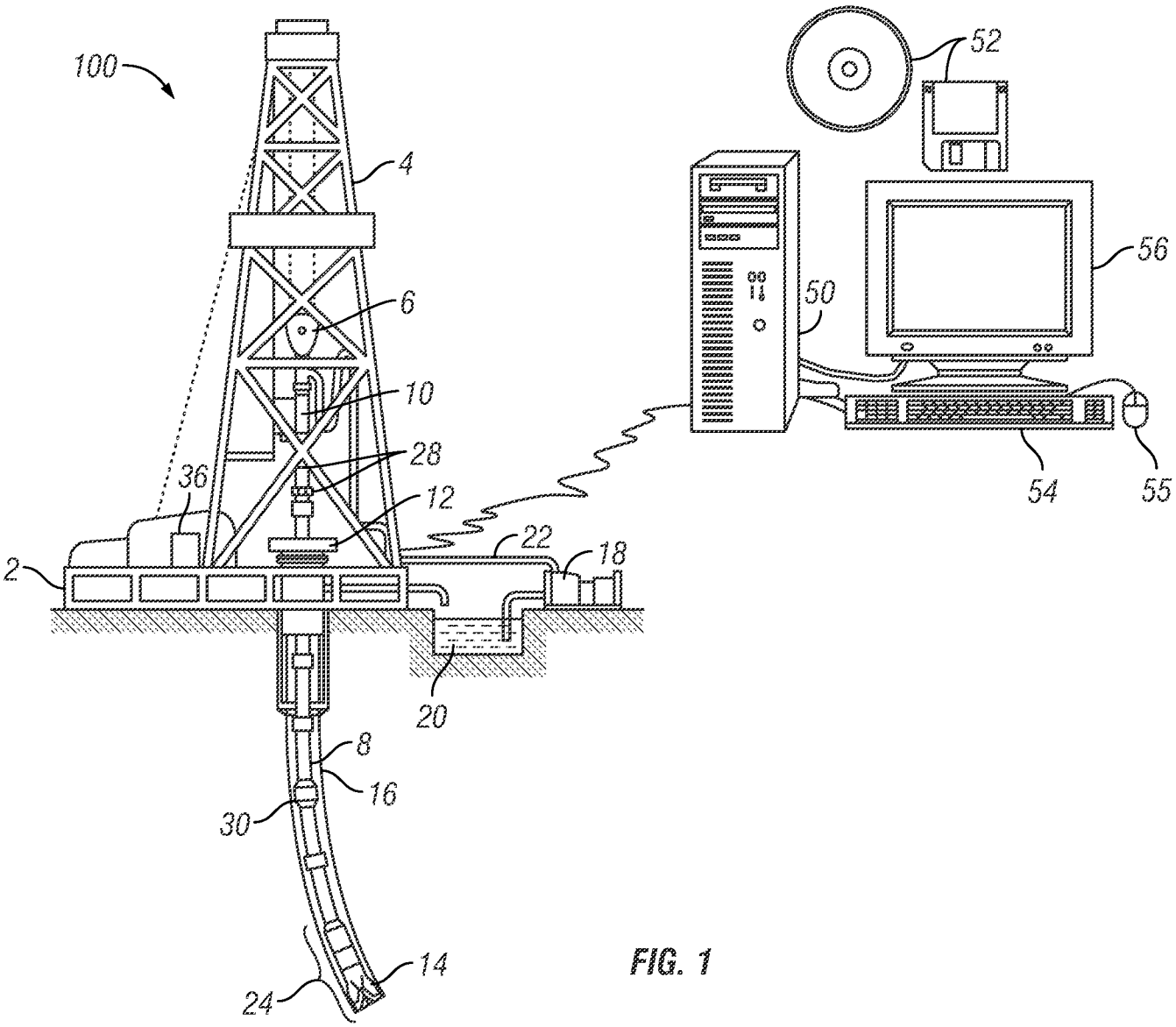
FIG. 1 depicts an elevation view of an example directional drilling system, according to one or more embodiments.

FIG. 1 depicts an elevation view of a drilling system 100 in accordance with one or more embodiments. As shown, a drilling platform 2 supports a derrick 4 having a traveling block 6 for raising and lowering a drill string 8. A top drive 10 supports and rotates the drill string 8 as it is lowered through the wellhead 12. A drill bit 14 is driven by a downhole motor and/or rotation of the drill string 8. As the bit 14 rotates, it creates a wellbore 16 that passes through various formations. A pump 18 circulates drilling fluid 20 through a feed pipe 22, through the interior of the drill string 8 to the drill bit 14. The fluid exits through orifices in the drill bit 14 and flows upward through the annulus around the drill string 8 to transport drill cuttings to the surface, where the fluid is filtered and recirculated.

The drill bit 14 is just one piece of a bottom-hole assembly 24 that includes a mud motor and one or more "drill collars" (thick-walled steel pipe) that provide weight and rigidity to aid the drilling process. Some of these drill collars include built-in logging instruments to gather measurements of various drilling parameters such as location, is orientation, weight-on-bit, wellbore diameter, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. For example, the tool may include a 3-axis fluxgate magnetometer and a 3-axis accelerometer. As is known in the art, the combination of those two sensor systems enables the measurement of the tool face angle, inclination angle, and compass direction. Such orientation measurements can be combined with gyroscopic or inertial measurements to accurately track tool position.

The bottom-hole assembly 24 may also include a device for measuring formation resistivity, a gamma ray device for measuring formation gamma ray intensity, devices for measuring the inclination and azimuth of the drill string 8, pressure sensors for measuring wellbore pressure, temperature sensors for measuring wellbore temperature, etc. Also included in bottom-hole assembly 24 is a telemetry sub that maintains a communications link with the surface. Mud pulse telemetry is one common telemetry technique for transferring tool measurements to surface receivers and receiving commands from the surface, but other telemetry techniques can also be used. For some techniques (e.g., through-wall acoustic signaling) the drill string 8 includes one or more repeaters 30 to detect, amplify, and re-transmit the signal. At the surface, transducers 28 convert signals between mechanical and electrical form, enabling a network interface module 36 to receive the uplink signal from the telemetry sub and (at least in some embodiments) transmit a downlink signal to the telemetry sub.

A computer system 50 located at the surface receives a digital telemetry signal, demodulates the signal, and displays the tool data or well logs to a user. Although FIG. 1 depicts the computer system 50 as being hardwired to the telemetry system, it should be appreciated that the computer system 50 may be in wireless communication with the telemetry system. The computer system 50 may include a processor and a non-transitory machine-readable medium 52 (e.g., ROM, EPROM, EEPROM, flash memory, RAM, a hard drive, a solid state disk, an optical disk, or a combination thereof) capable of executing instructions. The processor of the computer system 50 may include one or more processors located at the surface or in the wellbore, such as integrated with the bottom-hole assembly 24. Software (represented in FIG. 1 as the non-transitory machine-readable medium 52) governs the operation of the system 50. A user interacts with the system 50 and the software 52 via one or more input devices 54 and 55 and one or more output devices 56. In some system embodiments, an operator employs the system 50 to adjust geosteering operations (e.g., modifying the wellbore trajectory or steering the drill bit 14) and communicate appropriate commands to the bottom-hole assembly 24 to execute those decisions. The computer system 50 is operable to perform aspects of the methods of directional drilling the wellbore 16 as further described herein.

The drill string shown in FIG. 1 illustrates a directional drilling operation, wherein drilling is performed along a path or trajectory other than a straight vertical path downward. In at least some illustrative embodiments, the change in direction is achieved using a "bent sub" or "bend," which is a tubular section along the drill string near the drill bit that is bent or curved. The bend or curve may be fixed or variable, with the direction of the drilling being determined either by the bend alone, or by a combination of the bend and the rotation of the drill string. For example, if a downhole motor is used to drive the drill bit and a drill string with a fixed bent sub is maintained at a fixed azimuthal orientation, the drill string will gradually change direction towards the direction of the bend. If instead such a drill string is rotated, drilling will progress along a line parallel to the drill string section above the bend and about which the drill bit processes.

Figure 2A:
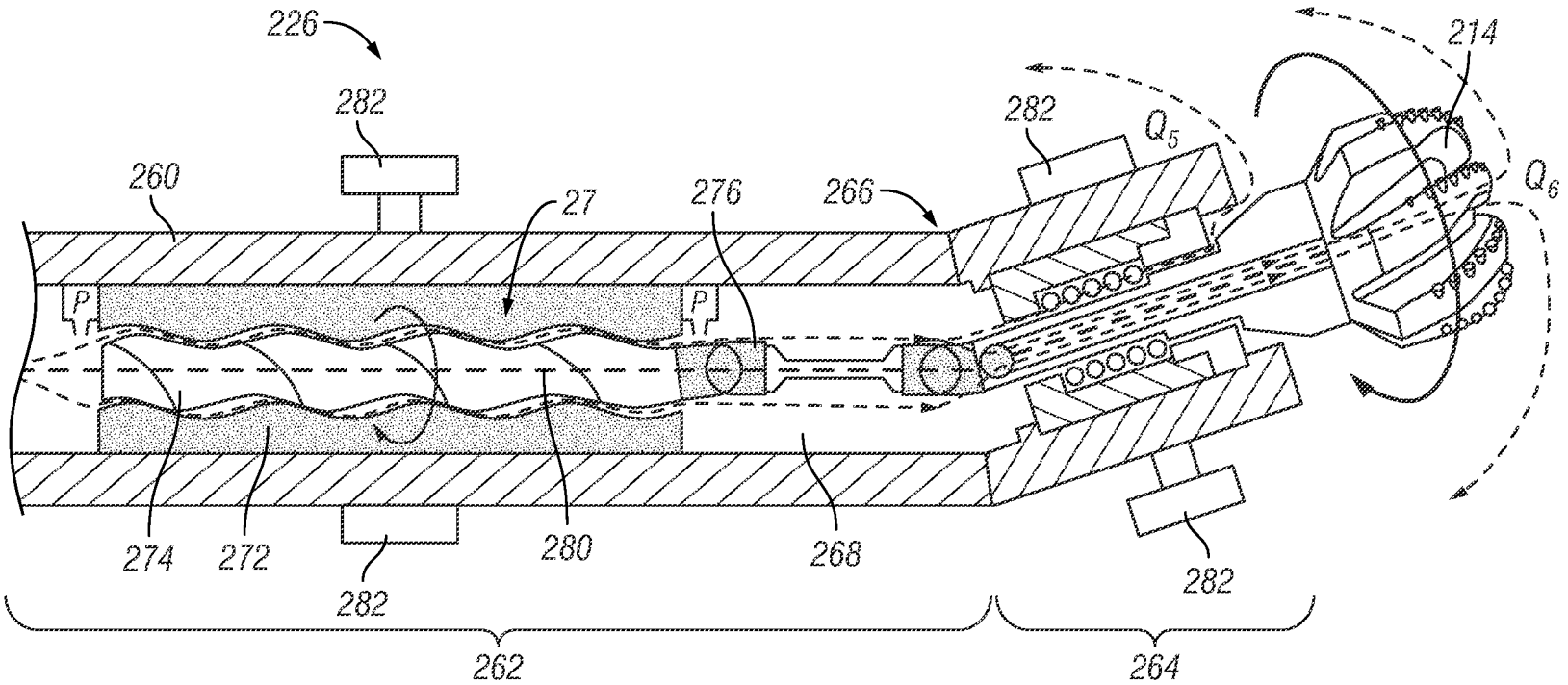
FIG. 2A depicts a cross-section view of a drilling assembly, according to one or more embodiments.

For drill strings capable of varying the angle of the bent sub, the sub is set to a desired angle and direction while the drill string is maintained at a desired fixed azimuthal orientation, with the drill bit being driven by the downhole motor. This is sometimes referred to as "slide drilling" or "sliding" as the drill string slides through the wellbore without rotating. For example, FIG. 2A shows a schematic view of a drilling assembly 226 employed to directionally drill the wellbore while sliding the drill string. The drilling assembly 226 includes a bent housing 260, a fluid-driven motor 270, a drill bit 214, and adjustable pads 282. The drilling assembly 226 may be a portion of the bottom-hole assembly of FIG. 1 and coupled to the drill string (not shown). The drilling assembly 226 is supported in the wellbore by the drill string and used to advance the wellbore via the drill bit 214.

The bent housing 260 is a tubular section of the drilling assembly 226 and includes a first, upper section that may receive the motor (i.e. motor section) 262 and a second, lower section 264 that may receive or at least orient the rotational axis of the bit 214, with a bend 266 between the upper section 262 and lower section 264. The angle of the bend is exaggerated in FIG. 1. The angle of the bend 266 may be on the order of, for example, 1.5° relative to the longitudinal axis 280 of the housing 260; although the angle of the bend 266 may alternatively be greater or less than 1.5°. The housing 260 is coupled to the drill string (not shown) and includes a bore 268 through which drilling fluid may flow as previously discussed.

The fluid-driven motor 270 rotates the drill bit 214 to form the wellbore through the formation. The fluid-driven motor 270 is coupled to the bent housing 260 and is a turbine motor with a stator 272 and a rotatable blade-bearing rotor 274 disposed inside the stator 272. Pressurized drilling fluid that is bypassed into the fluid-driven motor imparts a force on the angled rotor blades causing the rotor 274 to rotate within the stator 272. A drive shaft 276 is coupled to the rotor 272 and configured to output the rotational drive forces generated by the fluid-driven motor 270. The drive shaft 276 is coupled to the drill bit 214 and powers the rotation of the drill bit 2014.

The drill bit 214 is coupled to a lower end of the bent housing 260 and is used to crush or cut through the formation and form the wellbore. The drill bit 214 may be a roller-cone bit, a polycrystalline diamond compact (PDC) drill bit, or any other suitable drill bit. Positioning the housing 260 at a fixed azimuthal orientation allows the drill bit 214 to advance the wellbore in the direction of the bend 266 relative to the longitudinal axis 280 of the motor section 262.

The adjustable pads 282 are movable so that they can be alternately extended from or retracted towards the exterior of the housing 260 in response to controlled fluid pressure, to engage or disengage the wellbore wall to adjust the angle of the drill bit 214 and thus the direction of the drill bit 214 relative to the wellbore. Any one or more of the adjustable pads 282 may be extended to engage the wellbore to adjust the direction of the drill bit based on the displacement of the adjustable pad 282 from the exterior of the housing 260. The adjustable pads 282 may be axially and/or azimuthally spaced along the drilling assembly housing 260 to facilitate directional drilling. As shown in FIG. 2A, as set of two adjustable pads 282 are positioned below the bend 266, while another set of two adjustable pads 282 are positioned above the bend 266. The adjustable pads 282 are operable using a fluid control system including a piston in fluid communication with a valve or system of valves. The fluid control system, as further described herein, directs the flow of drilling fluid from the housing to adjust the displacement of the pad 282 relative to the exterior of the housing 260.

Figure 2B:
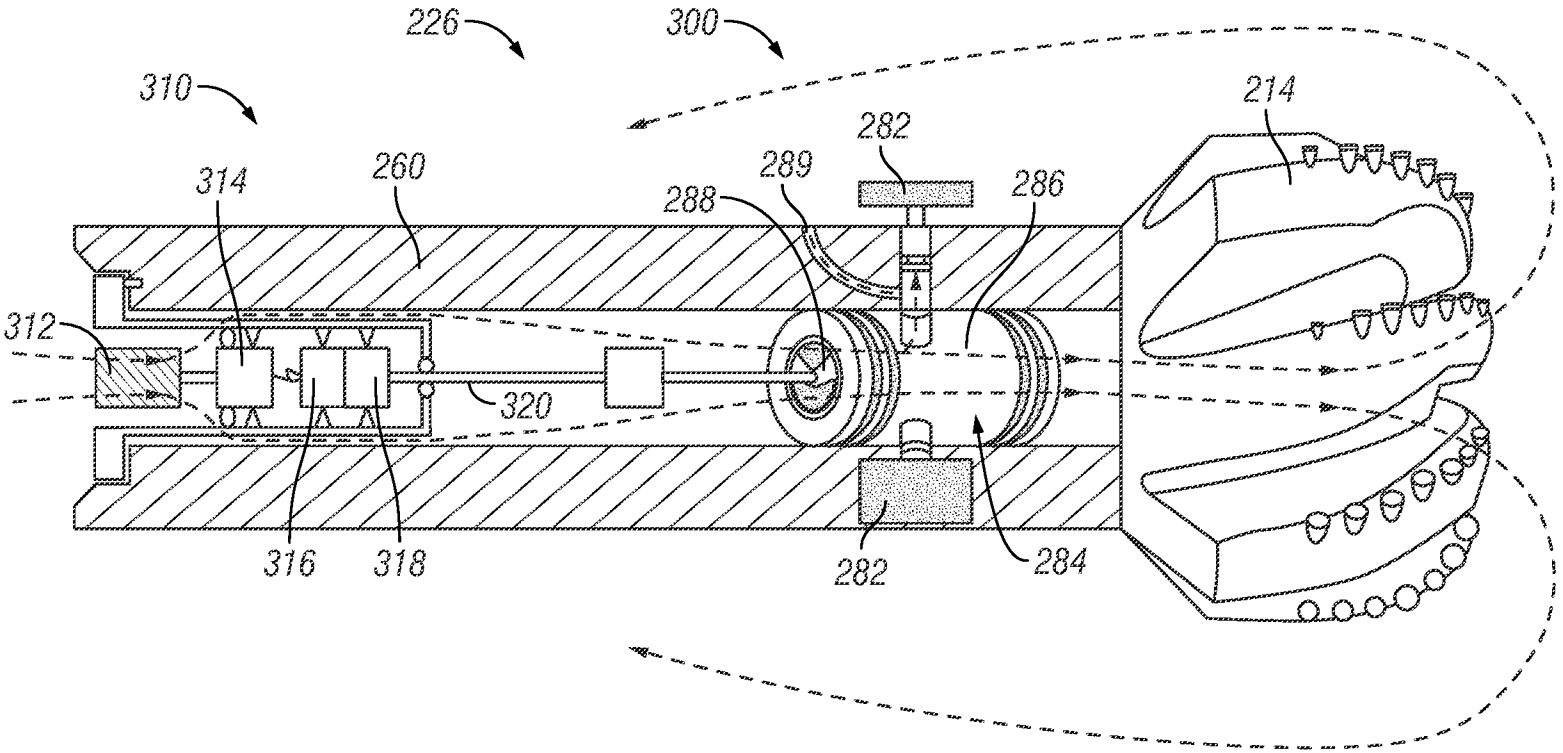
FIG. 2B depicts a cross-section view of the drilling assembly, according to one or more embodiments.

A fluid control system for extending or retracting the pads according to this disclosure may include any number of elements that collectively or cooperatively control fluid to the pads that are responsive to applied fluid pressure. Such a fluid control system may include, at least, a valve of some type involved in controlling the application of fluid directly or indirectly to control movement of the pads. Fluid control may include delivering fluid pressure to the pads to actively extend the pads when so desired. Fluid control may further include adjusting fluid flow or pressure to forcibly retract the pads. Fluid control may alternatively involve allowing the pads to passively retract, such as by releasing fluid pressure delivered to the pads so the pads may easily retract in response to forces applied by the wellbore wall. As an example, FIGS. 2B and 3A-3C show views of a valve 284 employed as part of the fluid control system 300 for controlling fluid flow to alternately extend or retract the adjustable pads 282, in accordance with one or more embodiments. As shown in FIG. 2B, the valve 284 includes a body 286 and a sealing element 288. The valve 284 is positioned in the bore of the housing 260 such that the sealing element 288 is rotatable on the longitudinal axis (280 of FIG. 2A) of the housing 260 to direct drilling fluid to the adjustable pad 282 or seal off drilling fluid from the adjustable pad 282, as further explained below. In FIG. 2B, the sealing element 288 is oriented to allow drilling fluid to flow through a channel 289 in fluid communication with the upper adjustable pad 282 and the annulus of the wellbore (not shown). The channel 289 allows fluid to vent to the annulus from the bore of the housing 260.

The orientation of the sealing element 288 may be adjusted via a motor assembly 310 or any other suitable device capable of rotating the sealing element to the orientation desired to set the displacement of the respective adjustable pad 282. The motor assembly 310 includes a fluid-driven motor 312, an electric generator 314, a controller 316, and an electric motor 318. The fluid-driven motor 312 may be a turbine motor, similar to that of the fluid-driven motor 270 of FIG. 2A, that drives the electric generator 314. The controller 316 may rectify and limit the power supplied to the electric motor 318 from the electric generator 314 to control the rotational output of the electric motor 318. The output shaft 320 of the electric motor is coupled to the sealing element 288 such that the rotation of the output shaft 320 rotates the sealing element 288.

It should be appreciated that the sealing element 288 may be oriented via any other suitable device. For instance, the sealing element 288 may be oriented via a device that is responsive to pressure pulses transmitted along the drill string through the drilling fluid. The sealing element 288 may also be oriented by sending darts or plugs into the bore of the drill string to actuate a device that can rotate the sealing element 288. It should also be appreciated that the drilling assembly 226 may include any number of valves 284 operably coupled to the adjustable pads 282 axially spaced along the drilling assembly 282 as depicted in FIG. 2A.

Figure 3A:
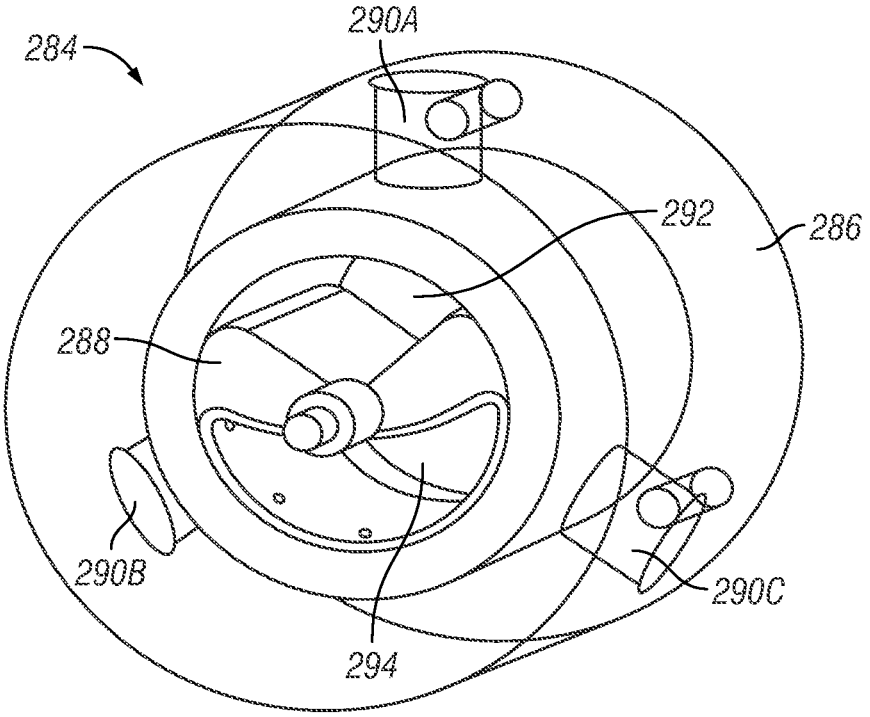
FIG. 3A depicts an isometric view of a valve employed in the drilling assembly of FIG. 2B, according to one or more embodiments.

FIG. 3A shows an isometric view of the valve 284 employed to extend or retract the adjustable pads of FIGS. 2A and B, in accordance with one or more embodiments. The valve 284 includes three flow channels 290A-C each separated by 120 degrees. Each flow channel 290A-C is in communication with an adjustable pad 282 as depicted in FIG. 2B. The valve 284 depicted in FIG. 3A provides for the extension or retraction of three adjustable pads 282. The valve 284 may include any number of flow channels in fluid communication with a corresponding number of adjustable pads.

The sealing element 288 is shaped to form two flow paths 292, 294 through the bore of the valve body 286. The upper flow path 292 of FIG. 3A is formed between the bore of the body 286 and the sealing element 288; whereas the lower flow path 294 is formed by the sealing element 288. In FIG. 3A, the sealing element is oriented such that the lower flow path 294 prevents fluid from entering the lower channels 290B and C, and the upper flow path 292 allows fluid to enter the upper channel 290A. The drilling fluid that enters the upper channel 290A displaces the adjustable pad 282 away from the exterior of the drilling assembly housing of FIG. 2A.

Figure 3B:
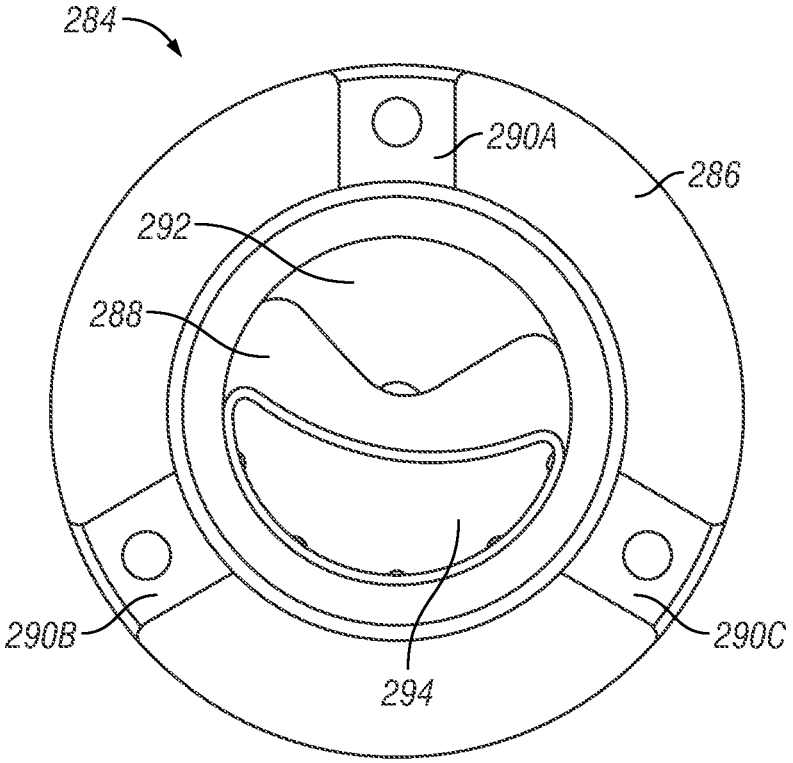
FIG. 3B depicts a cross-section view of the valve of FIG. 3A, according to one or more embodiments.
Figure 3C:
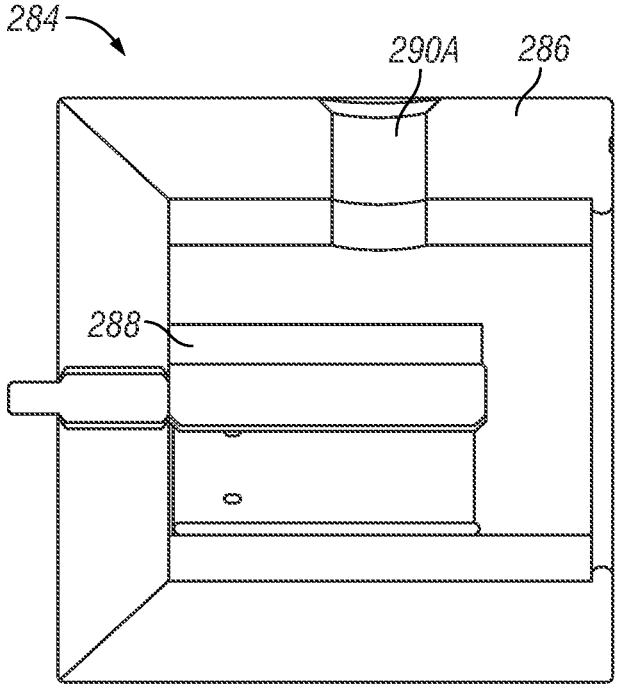
FIG. 3C depicts another cross-section view of the valve FIG. 3A, according to one or more embodiments.

FIG. 3B shows a cross-section view of the valve 284 oriented to allow fluid to enter the upper flow channel 290A. In FIG. 3B, the valve 284 is shown looking down the bore of the body 286. Likewise, FIG. 3C shows a cross-section view of the valve 284. In FIG. 3C, the valve 284 is shown looking perpendicular to the longitudinal axis of the valve 284. FIGS. 3B and C demonstrate the orientation of the sealing element 288 to allow fluid to enter the upper flow channel 290A while sealing the lower flow channels 290B and C.

Figure 4:
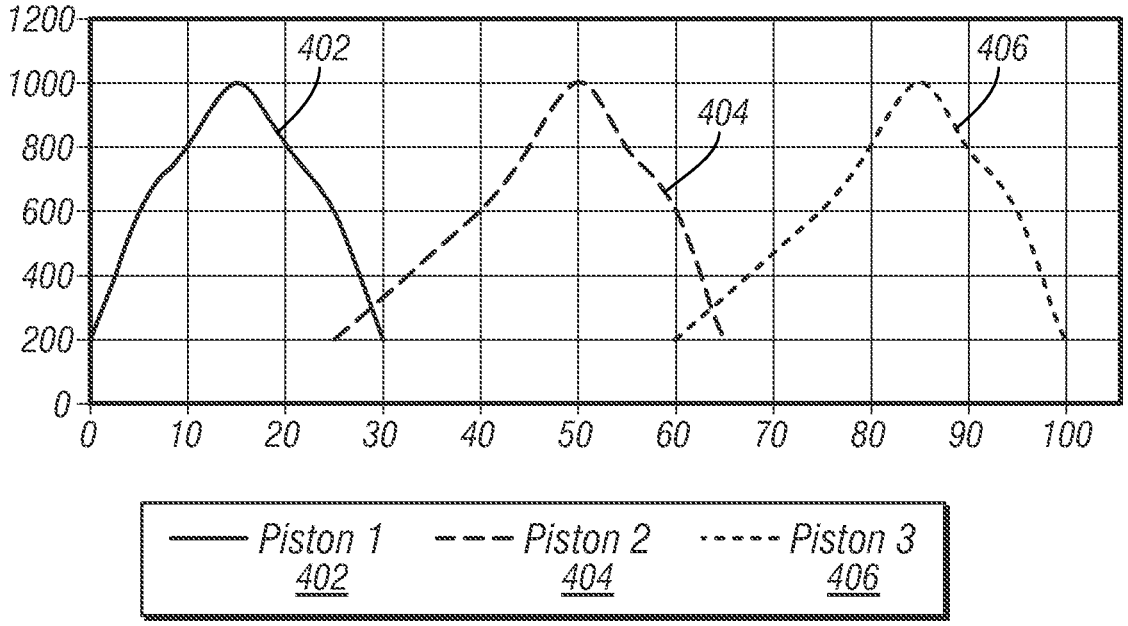
FIG. 4 depicts a graph view of curves for the pressure response of the flow channels of the valve of FIG. 3A, according to one or more embodiments.

FIG. 4 shows a graph view of pressure curves 402, 404, 406 of the valve 284 of FIGS. 3A-C as the sealing element 288 rotates in the valve body 286. As shown, the pressure curves 402, 404, 406 are functions of pressure over time. Each pressure curve 402, 404, 406 represents the pressure applied to a separate adjustable pad 282 as the sealing element 288 rotates in the valve body 286 to allow fluid to vent to the wellbore annulus or seal off fluid the wellbore annulus. At each peak of the pressure curves 402, 404, 406, the sealing element 288 is oriented such that the flow channel associated with the adjustable pad is open to allow fluid from the drilling assembly housing to the wellbore annulus to fully extend the corresponding adjustable pad 282. In contrast, at the local minima of the pressure curves 402, 404, 406, the sealing element 288 is oriented to seal off the fluid from the drilling assembly and retract the corresponding adjustable pad 282. In between the peaks and local minima, the sealing element 288 is oriented to partially close the flow channel associated with the adjustable pad 282. The pressure curves 402, 404, 406 demonstrate that the orientation of the sealing element 288 facilitates adjusting the displacement of the adjustable pads 282 from the exterior drilling assembly.

Figure 5A:
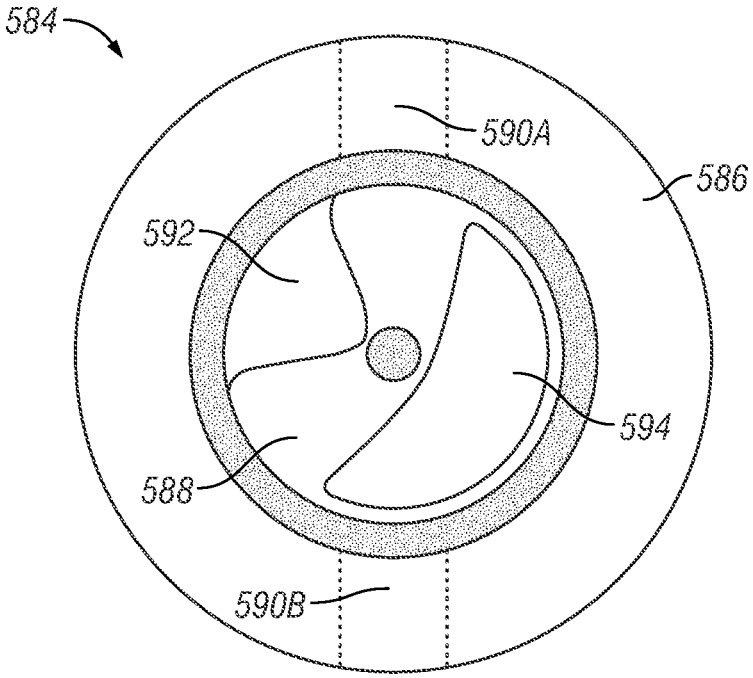
FIG. 5A depicts a cross-section view of an orientation for the sealing element of a valve of the drilling assembly, according to one or more embodiments.
Figure 5B:
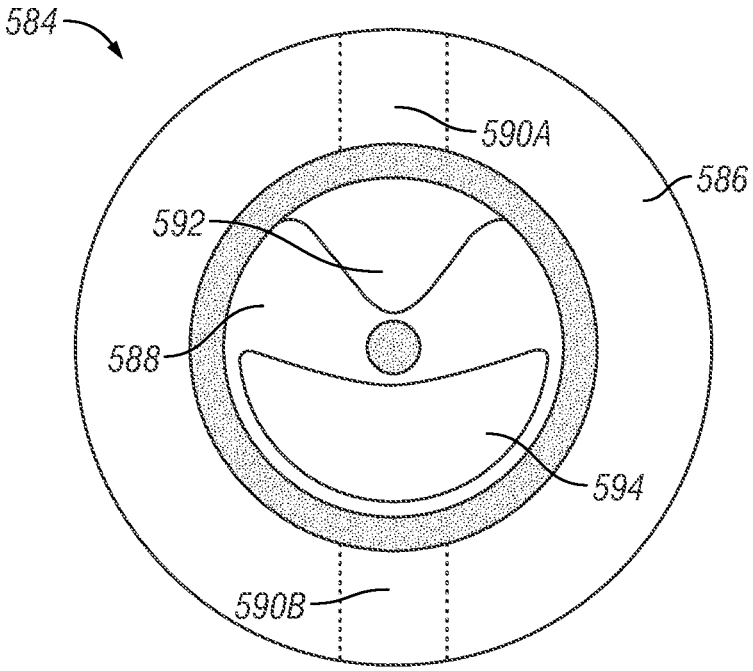
FIG. 5B depicts a cross-section view of another orientation for the sealing element of a valve of the drilling assembly, according to one or more embodiments.

FIG. 5A shows a cross-section view of another example of a valve 584 employed to extend or retract the adjustable pad 282 in FIG. 2A, in accordance with one or more embodiments. The valve 584 includes two flow channels 590A and B separated by 180 degrees. Each flow channel 590A and B is in communication with an adjustable pad 282 as depicted in FIG. 2B, such that the valve 584 depicted in FIG. 5A provides for the extension or retraction of two adjustable pads 282. As shown, the sealing element 588 is oriented to seal off fluid from flowing into either of the flow channels 590A and B such that the two adjustable pads 282 are fully retracted. FIG. 5B shows the sealing element 588 oriented to allow fluid to flow into the upper flow channel 590A to fully extend the adjustable pad 282 in fluid communication with the upper flow channel 590A.

The adjustable pads and valve system described herein thus enable variability in the bend angle of the drilling assembly. The adjustable pads also enable varying the forces applied to the drilling assembly via the pad-wellbore contact and the time interval of the force. Therefore, the adjustable pads provide for far more control of directional change and tortuosity than with a conventional motor application.

The adjustable pads also enable reducing the bend angle of the drilling assembly. This can be used to reduce the stress levels encountered by the fluid-driven motor which may improve motor reliability and performance improvements. Less stress on the fluid-driven motor provides less risk of the fluid-driven motor overheating, which in turn reduces the risk of motor chunking. Less stress on the fluid-driven motor also improves operational life and reduces replacement and maintenance costs. Reducing the bend angle of the drilling assembly may also enable the drill bit to rotate at higher RPMs relative to a high bend setting. The high bend setting can restrict the RPM output of the drill bit. With a higher drill bit RPM, the lower bend setting also enables an increased weight-on-bit (WOB) applied to the drilling assembly from the surface before the drill bit is overloaded. Reducing the bend angle of the drilling assembly may also enable the drilling assembly to be rotated at higher RPMs during rotary drilling (not sliding). Higher RPMs of the drilling assembly with larger bend settings increase the fatigue on and around the bend as a result of cyclic stress loading. Reducing the bend with the adjustable pads would allow the application of higher RPMs from the surface, reducing cyclic stress and enabling an increased WOB and rate of penetration through the formation.

The adjustable pads also provide directional drilling that respond to formations that are prone to hole enlargement. Such formations may increase in hole size restricting the bend angle of the drilling assembly without an adjustable pad. The adjustable pad can offset these formation types by extending the adjustable pad as the hole size increases.

In addition to the embodiments described above, many examples of specific combinations are within the scope of the disclosure, some of which are detailed below:

Example 1

A drilling assembly for drilling a wellbore comprising a wall, comprising:

- a bent housing comprising an upper section, a lower section, a bend between the upper and lower sections, and a bore extending from the upper to lower sections;
- a drill bit coupled to a lower end of the bent housing;
- a fluid-driven motor coupled to the bent housing and comprising a drive shaft coupled to the drill bit;
- an adjustable pad extendable and retractable from an exterior of the bent housing to engage and disengage the wellbore wall to adjust a drilling direction of the drill bit; and a fluid control system operable to control extension of the pad.

Example 2

The drilling assembly of example 1, wherein the fluid control system comprises a valve comprising a sealing element rotatable on an axis of the bent housing, the sealing element rotatable to seal off fluid communication between the bore and the adjustable pad.

Example 3

The drilling assembly of example 1, wherein the adjustable pad is positioned below the bend.

Example 4

The drilling assembly of example 1, wherein the adjustable pad is positioned above the bend.

Example 5

The drilling assembly of example 1, further comprising an additional adjustable pad in fluid communication with the fluid control system.

Example 6

The drilling assembly of example 1, wherein the additional adjustable pad is azimuthally spaced from the adjustable pad.

Example 7

The drilling assembly of example 1, further comprising an additional adjustable pad in fluid communication with an additional fluid control system and axially spaced from the adjustable pad.

Example 8

The drilling assembly of example 7, wherein the additional adjustable pad is positioned below the bend.

Example 9

The drilling assembly of example 7, wherein the additional adjustable pad is positioned above the bend.

Example 10

The drilling assembly of example 1, wherein the additional adjustable pad is radially extendable in an opposite direction from that of the adjustable pad.

Example 11

A method of directional drilling a wellbore with a wall, comprising:

rotating a drill bit on a drilling assembly with a fluid-driven motor in the wellbore, the drilling assembly comprising a bent housing comprising an upper section, a lower section, and a bend between the upper and lower sections;

radially extending an adjustable pad from the exterior of the drilling assembly using a fluid control system operable to control extension of the pad to engage or disengage the wellbore wall to adjust the drilling direction of the bit; and extending the wellbore with drill bit in the direction set by the adjustable pad.

Example 12

The method of example 11, wherein radially extending the adjustable pad comprises rotating a valve on an axis of the bent housing to adjust a drilling direction of the drilling assembly.

Example 13

The method of example 11, wherein the adjustable pad is located below the bend of the housing.

Example 14

The method of example 11, wherein the adjustable pad is located above the bend of the housing.

Example 15

The method of example 11, further comprising radially extending an additional adjustable pad from the exterior of drilling assembly to engage or disengage the wellbore wall to adjust the drilling direction of the bit.

Example 16

The method of example 11, wherein the additional adjustable pad is extendable in an opposite direction from that of the adjustable pad.

Example 17

A system, comprising:

a drill string; and a drilling assembly coupled to the drill string, the drilling assembly comprising:

a bent housing comprising an upper section, a lower section, a bend between the upper and lower sections, and a bore extending from the upper to lower sections;

a drill bit coupled to a lower end of the bent housing, a fluid-driven motor coupled to the bent housing and comprising a drive shaft coupled to the drill bit, and an adjustable pad extendable and retractable from an exterior of the bent housing to engage and disengage the wellbore wall to adjust a drilling direction of the drill bit; and a fluid control system operable to control extension of the pad;

Example 18

The system of example 17, wherein the fluid control system comprises a valve comprising a sealing element rotatable on an axis of the bent housing, the sealing element rotatable to seal off fluid communication between the bore and the adjustable pad.

Example 19

The system of example 17, wherein the drilling assembly further comprises an additional adjustable pad in fluid communication with the fluid control system.

Example 20

The system of example 17, wherein the drilling assembly further comprises an additional adjustable pad in fluid communication with an additional fluid control system and axially spaced from the adjustable pad.

This discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A drilling assembly for drilling a wellbore comprising a wall, comprising:

a bent housing comprising an upper section, a lower section, a bend between the upper and lower sections, and a bore extending from the upper to lower sections;

a drill bit coupled to a lower end of the bent housing;

a fluid-driven motor coupled to the bent housing and comprising a drive shaft coupled to the drill bit;

an adjustable pad extendable and retractable from an exterior of the bent housing to engage and disengage the wellbore wall to adjust a drilling direction of the drill bit; and a fluid control system operable to control extension of the pad, the fluid control system comprising a valve within the bore, the valve comprising a sealing element rotatable within a body of the valve on a longitudinal axis of the bent housing, the sealing element rotatable to seal off fluid communication between the bore and the adjustable pad.

2. The drilling assembly of claim 1, wherein the adjustable pad is positioned below the bend.

3. The drilling assembly of claim 1, wherein the adjustable pad is positioned above the bend.

4. The drilling assembly of claim 1, further comprising an additional adjustable pad in fluid communication with the fluid control system.

5. The drilling assembly of claim 4, wherein the additional adjustable pad is azimuthally spaced from the adjustable pad.

6. The drilling assembly of claim 1, further comprising an additional adjustable pad in fluid communication with an additional fluid control system and axially spaced from the adjustable pad.

7. The drilling assembly of claim 6, wherein the additional adjustable pad is positioned below the bend.

8. The drilling assembly of claim 6, wherein the additional adjustable pad is positioned above the bend.

9. The drilling assembly of claim 6, wherein the additional adjustable pad is radially extendable in an opposite direction from that of the adjustable pad.

10. A method of directional drilling a wellbore with a wall, comprising:

rotating a drill bit on a drilling assembly with a fluid-driven motor in the wellbore, the drilling assembly comprising a bent housing comprising an upper section, a lower section, and a bend between the upper and lower sections;

radially extending an adjustable pad from the exterior of the drilling assembly using a fluid control system to rotate a sealing element within a body of a valve within a bore of the bent housing on a longitudinal axis of the bent housing to adjust the drilling direction of the bit; and extending the wellbore with drill bit in the direction set by the adjustable pad.

11. The method of claim 10, wherein the adjustable pad is located below the bend of the housing.

12. The method of claim 10, wherein the adjustable pad is located above the bend of the housing.

13. The method of claim 10, further comprising radially extending an additional adjustable pad from the exterior of drilling assembly to engage or disengage the wellbore wall to adjust the drilling direction of the bit.

14. The method of claim 13, wherein the additional adjustable pad is extendable in an opposite direction from that of the adjustable pad.

15. A system, comprising:

a drill string; and a drilling assembly coupled to the drill string, the drilling assembly comprising:

a bent housing comprising an upper section, a lower section, a bend between the upper and lower sections, and a bore extending from the upper to lower sections;

a drill bit coupled to a lower end of the bent housing;

a fluid-driven motor coupled to the bent housing and comprising a drive shaft coupled to the drill bit; and an adjustable pad extendable and retractable from an exterior of the bent housing to engage and disengage the wellbore wall to adjust a drilling direction of the drill bit; and a fluid control system operable to control extension of the pad, the fluid control system comprising a valve within the bore, the valve comprising a sealing element rotatable within a body of the valve on a longitudinal axis of the bent housing, the sealing element rotatable to seal off fluid communication between the bore and the adjustable pad.

16. The system of claim 15, wherein the drilling assembly further comprises an additional adjustable pad in fluid communication with the fluid control system.

17. The system of claim 15, wherein the drilling assembly further comprises an additional adjustable pad in fluid communication with an additional fluid control system and axially spaced from the adjustable pad.

* * * * *